United States Patent [19]

Stookey

[11] 4,266,012

[45] May 5, 1981

[54] COLOR PHOTOGRAPHIC PROCESS UTILIZING POLYCHROMATIC GLASS

[75] Inventor: Stanley D. Stookey, Painted Post, N.Y.

[73] Assignee: Corning Glass Works, Corning, N.Y.

[21] Appl. No.: 82,143

[22] Filed: Oct. 5, 1979

[51] Int. Cl.[3] ..... G03C 5/04

[52] U.S. Cl. ..... 430/396; 430/13

[58] Field of Search ..... 65/30 R, 30 E, DIG. 2, 65/33; 430/28, 13, 396; 106/52

[56] References Cited

U.S. PATENT DOCUMENTS

| | | | |
|---|---|---|---|
| 2,911,749 | 11/1959 | Stookey | 430/13 |
| 3,951,659 | 4/1976 | Abita et al. | 430/396 |
| 4,003,745 | 1/1977 | Blanks | 430/396 |
| 4,017,318 | 4/1977 | Pierson et al. | 430/13 |
| 4,086,089 | 4/1978 | Seward et al. | 430/28 |
| 4,092,139 | 5/1978 | Ference | 106/52 |

*Primary Examiner*—Won H. Louie, Jr.

*Attorney, Agent, or Firm*—Clinton S. Janes, Jr.

[57] ABSTRACT

The instant invention is related to the screen-plate color photographic process and involves utilizing a glass plate having within its surface an integral, micromosaic array of polycolor elements consisting of 3-8 subelement color filters therein as the screen. The array of polycolor elements is prepared by sequentially or simultaneously exposing a polychromatic glass body in patterned portions to high energy or actinic radiation, following with heat treatments with and without reexposure to develop the desired colors in the glass.

43 Claims, 9 Drawing Figures

COLOR PHOTOGRAPHIC PROCESS UTILIZING POLYCHROMATIC GLASS

BACKGROUND OF THE INVENTION

Colored photosensitive glasses or polychromatic glasses, as such products have more recently been termed, had their genesis in U.S. Pat. No. 4,017,318. Colors encompassing the entire spectrum of visible coloration can be developed within a single glass composition following that inventive concept.

As is disclosed in that patent, the base compositions for such glasses require the presence of silver, an alkali metal oxide, customarily $Na_2O$, fluoride, and at least one other halide selected from the group chloride, bromide, and iodide. The glasses are exposed to high energy or actinic radiations selected from the group of high velocity electrons, X-radiations, and ultraviolet radiations in the range of about 2800 Å–3500 Å. Where ultraviolet radiations comprise the actinic radiation, $CeO_2$ will be included in the glass composition.

In the method described therein capable of producing a full spectrum of colors, the glass is initially irradiated with high energy or actinic radiations to develop a latent image therein. The length of this exposure and the flux thereof, i.e., the energy/unit area of the irradiation, determine the final color that will be exhibited by the glass. Thereafter, the glass is subjected to a heat treatment at a temperature between about the transformation range and the softening point thereof to precipitate colloidal silver particles in situ which perform as nuclei. In the case of a transparent colored glass, this heat treatment is undertaken only for so long as to effect precipitation of colloidal silver nuclei with the possible growth thereon of extremely small microcrystals of alkali metal fluoride-silver halide, normally, for example, NaF+(AgCl and/or AgBr and/or AgI).

The nucleated glass is subsequently cooled, commonly to room temperature but at least to a temperature 25° C. below the strain point of the glass, and again exposed to high energy or actinic radiation. This second exposure develops the color, the hue of which had been determined through the previous exposure. Finally, the glass is reheated to a temperature between about the transformation range and the softening point of the glass to bring out the desired color.

The mechanism of color production was acknowledged as not being fully understood but it was postulated that the quantity of silver precipitated and the geometry of the precipitated particles, as well as perhaps the refractive index of the crystals developed, determined the colors manifested. Nevertheless, because the colors can be obtained with very minor quantities of silver, it was deduced that at least one of the following situations was present: (a) the presence of discrete colloidal particles of silver less than about 200 Å in the smallest dimension; (b) the presence of metallic silver deposited within the alkali metal fluoride-silver halide microcrystals, the silver-containing portion of the microcrystals being less than about 200 Å in the smallest dimension; and (c) the presence of metallic silver deposited upon the surface of the microcrystals, the silver-coated portion thereof being less than about 200 Å in the smallest dimension. The microcrystals are present in the glass in a concentration of at least about 0.005% by volume.

The patent further observed that consecutive or interrupted heat treatments, either subsequent to the initial irradiation to high energy or actinic radiation or following the second irradiation step, can act to intensify the final color produced. Accordingly, whereas the cause of this phenomenon was not comprehended, empirical evidence indicated that two or more heat treatments at temperatures between the transformation range and softening point of the glass can enhance and make the color resulting therefrom more vivid than is achieved through a single heat treatment of equal or longer duration.

As was mentioned above, the patent also noted that the identity of the color produced in the glass was dependent upon the duration and flux of the first exposure to high energy or actinic radiation. Thus, it was observed that the least quantum of exposure developed a green coloration followed by blue, violet, red, orange, and yellow as the exposure time and/or flux was increased.

U.S. Pat. No. 4,092,139 discloses an improvement upon the basic method for producing polychromatic glasses, as set forth in U.S. Pat. No. 4,017,318, supra, which shortens the time required for generating the desired colors and the colors, themselves, are frequently more vivid. The preferred embodiment of that inventive method involved four general steps:

(a) a glass article is formed having a composition included within the ranges described in U.S. Pat. No. 4,017,318;

(b) the glass article is exposed to high energy or actinic radiation for a sufficient period of time to develop a latent image therein;

(c) the glass article is removed from the high energy or actinic radiation and heated to a temperature between the transformation range and the softening point of the glass for a length of time sufficient to cause nucleation and growth of microcrystals of alkali metal fluoride containing at least one silver halide selected from the group of AgCl, AgBr, and AgI; and then (d) the glass article is re-exposed to high energy or actinic radiation while at a temperature between about 200°–410° C. for a period of time adequate to cause metallic silver to be deposited as discrete colloidal particles less than about 200 Å in the smallest dimension, and/or deposited upon the surface of said microcrystals, the silver-coated portion of the microcrystal being less than about 200 Å in the smallest dimension; and/or deposited within said microcrystals, the silver-containing part of the microcrystal being less than about 200 Å in the smallest dimension, said microcrystals having a concentration of at least 0.005% by volume.

Where desired, the first irradiation step may also be conducted at temperatures between about 200°–410° C. That technique does not appear to significantly improve the intensity of the final color in the glass, although it does have the advantage of reducing the time demanded for nucleation and incipient crystallization. However, when this first irradiation of the glass at elevated temperatures is prolonged for too extended a period of time, the glass will develop a permanent yellowish cast which obviously is unwanted where a spectrum of colors is desired.

As can be seen, both U.S. Pat. No. 4,017,318 and U.S. Pat. No. 4,092,139 require two exposures to high energy or actinic radiation to develop a spectrum of colors. Customarily, when practicing those inventions, the first irradiation treatment will typically be of relatively short duration, to more than several minutes. The second exposure, however, will commonly be for a much longer period, e.g., one hour or more, even when combined with the second heat treatment as disclosed in U.S. Pat. No. 4,092,139. Such practice is not only expensive due to the energy required for the long term exposure to high intensity radiation, but also limits the size and geometry of articles that can be treated.

U.S. Pat. No. 4,118,214 describes a further improvement upon the basic disclosure relating to polychromatic glasses, as set forth in U.S. Pat. No. 4,017,318, which alleviates those problems. Hence, the improvement lies in the finding that the second irradiation treatment with high energy or actinic radiation can be eliminated without sacrificing any portion of the spectrum of colors and the colors are equivalent in intensity to those produced according to the processes of the two abovementioned patents. The inventive method contemplates firing the nucleated glass, i.e., the glass subjected to the initial irradiation step and heat treatment, in a gaseous reducing atmosphere at temperatures of at least 350° C., but not above the strain point of the glass, and at gas pressures greater than ambient pressure. When temperatures above the strain point of the glass are employed, the color centers in the glass are thermally altered with the glass commonly taking on a permanent yellow coloration.

The method is operable with the glass compositions described in U.S. Pat. No. 4,017,318. The preferred compositions reported therein consist essentially, in weight percent on the oxide basis, of about 10–20% $Na_2O$, 0.0005–0.3% Ag, 1–4% F, an amount of at least one halide selected from the group of Cl, Br, and I at least sufficient to react stoichiometrically with the Ag, but not more than a total of 4%, and the remainder $SiO_2$. Where ultraviolet radiation with wavelengths between about 2800 Å–3500 Å comprises the actinic radiation, about 0.01–0.2% $CeO_2$ will be included in the composition. Furthermore, $Sb_2O_3$ and/or SnO can be utilized as thermoreducing agents in the stated proportions of about 0.1–1% $Sb_2O_3$ and/or about 0.01–1% SnO, with the total $Sb_2O_3$+SnO not exceeding about 1%. Up to 18% ZnO and up to 10% $Al_2O_3$ are stated to be useful additions.

In further delineating the character of the glasses, each of the three patents discussed above noted that, in the case of transparent glasses, the concentration of microcrystals therein will be maintained below about 0.1% by volume and the size thereof will be no larger than about 0.1 micron in diameter. Finally, to insure the preparation of transparent glasses, the silver content will customarily be held below about 0.1% by weight, the fluoride level will not exceed about 3% by weight, and the total of the remaining halides will be maintained below about 2% by weight.

An atmosphere of hydrogen constitutes the most effective reducing environment in terms of production speed. Reducing atmospheres less hazardous than hydrogen alone are well recognized in the art, e.g., cracked ammonia, mixtures of CO and $CO_2$, and various blends of $N_2$ and $H_2$, marketed under the term, forming gas. These environments are also effective but require longer firing periods.

The rate of hydrogen permeation into glass is dependent upon the exposure temperature and the pressure of the hydrogen-containing atmospheres. Consequently, the diffusion rate will be increased when the temperature at which the glass is subjected to the hydrogen environment is raised and/or the pressure of the hydrogen atmosphere is increased. Furthermore, the use of wet reducing gas, e.g., forming gas that has been passed through liquid water or otherwise combined with water vapor, may be more effective than gas in the dry state.

To recapitulate, the optimum temperature for the thermoreducing treatment will desirably be as high as possible to maximize hydrogen diffusion into the glass, but below the strain point of the glass. Where pure hydrogen is utilized as the reducing environment, treatment temperatures between about 425°–475° C. are preferred. A temperature of about 500° C. is deemed to constitute a practical maximum to permit careful control of color production. The inventive method enables the development of very vivid colors in thin layers of glass, the depth of the layer depending upon the duration of the hydrogen firing.

U.S. Pat. No. 4,017,318 describes attempts to produce color photographs in the glass. Although, as is illustrated therein, faithful images of the objects to be photographed were secured, the colors of the original objects were not successfully reproduced in the glass. Hence, while achieving high optical resolution in the glass, utility in the color photography market demanded a matching and/or improvement upon the colors.

One color photographic process employing glass plates which has been marketed commercially, but on a relatively small scale, has been designated the "Screen-Plate Process". This process involves mechanically laying down a patterned mosaic array or screen of large numbers of very tiny red, green, and blue filters on a glass plate, those filters conventionally consisting of coatings containing organic dyes. This array is placed directly in contact with a panchromatic film of the type employed in black-and-white photography. The camera exposure is made through the array. After exposure, the film is developed by reversal to yield a positive silver image or, alternatively, a negative is first prepared and a positive then made therefrom. This combination of polychromatic filter plate and the black-and-white emulsion backing is the completed color transparency picture which is viewed directly or projected onto a screen by passing light back through the silver image in combination with the original plate, or one having an identical array of color filters. The color filters control the spectral characteristics of the transmitted light and the relative intensities are a function of the densities of the silver image. The color filters are of such size that the light transmitted through them visually fuses to yield additive color mixtures.

SUMMARY OF THE INVENTION

The present invention discloses an improvement upon the general Screen-Plate Process for color photography, the crux of the invention involving the use of polychromatic glass as a necessary key component both in exposing and in viewing the picture. In the most general terms, the invention comprises replacing the earlier types of mechanically-prepared, three-color mosaic filter array by a three-to-eight-color, integral, patterned, uniform micromosaic filter plate or thin film of polychromatic glass.

Polychromatic glasses possess two intrinsic characteristics which recommend their utility in this color photography process; viz., (1) the capability of having a full spectrum of colors developed therein, and (2) their high optical resolution. Therefore, because polychromatic glasses can provide a many-color system, having more degrees of freedom than a three-color system, the photograph resulting therefrom has a broader range of colors and, hence, provides a truer reproduction of colors. Furthermore, the overall process is simpler and less expensive since the commercial process requires different materials or layers for each of the three colors produced.

In the general practice of the invention, the polychromatic glass is in the form of a thin (0.01-1.5 mm) plate or film. Within the surface of the glass is an integral, patterned, uniform micromosaic array of color filter dots (or squares, circles, rectangles, triangles, lines, or other desired configurations), each dot transmitting one band of the color spectrum. Dots representing as few as three primary colors (red, blue, and green), or as many as six or eight sections of the color spectrum, may be employed. The "dot" size must obviously decrease as the number of colors is increased, so that the color pattern observed by the viewer appears as a properly balanced composite having no apparent granularity.

The size of a polycolor element, the "dot", containing all of the color subelements should not exceed about 0.020" (~500 microns). It is at this point that the very high optical resolution exhibited by the glass shows itself to great advantage. As a matter of fact, this optical resolution may test the grain size of the panchromatic emulsion backing. An approximate indication of color balance is provided when the plate displays a neutral composite color. An imbalance caused by the presence of color subelements having different transmittances can be countered by enlarging the relative area of that color having insufficient specific transmittance.

Several methods have been disclosed for forming photographically-integral, patterned arrays of micromosaic color "dots". Three of the most widely used processes involve: (1) utilizing a first exposure to high energy or actinic radiation which consists of a single exposure through a patterned, continuous tone black-and-white photographic negative, the pattern having three or more optical densities to control the exposure intensities and thereby vary the colors of the dot pattern; (2) utilizing three or more exposures, depending upon the number of colors desired, through appropriately patterned screens or stencils; and (3) utilizing a scanning exposure employing computer-controlled, focussed or laser beams of ultraviolet radiation, the intensities and positions of which are determined by the computer.

Method (1) requires a preliminary step of predetermining the optical densities, or steps in the gray scale of the negative, which correspond to the desired colors in the mosaic pattern to be developed in polychromatic glass, and then photographically producing the properly calibrated pattern on a film or glass plate capable of transmitting actinic radiation.

The formation of an integral, patterned array of micromosaic color dots can be undertaken in accordance with Method 2 utilizing conventional techniques of stenciling or masking. For example, U.S. Pat. No. 4,086,089 describes producing patterned color-triad arrays in polychromatic glass for use in color television picture tube faceplates utilizing an appropriate electron shadow mask (dot or slot-like apertures) as the "negative" and exposing the glass therethrough to high energy or actinic radiation. As is explained there, the shadow mask had one hole per triad. Three exposures were conducted using the proper time, intensity, wavelength of radiation, and beam registry conditions to produce the color-triad arrays. Thereafter, the exposed glass was subjected to heat treatments and reexposures to bring out the colors. Dots or slots demonstrating good registry were formed by placing the shadow mask in contact with the glass and moving the glass a distance equal to about one-third of the hole separation after each exposure.

An equally operable embodiment of the method involved positioning the mask at a uniform distance from the glass and conducting three exposures using well-collimated high energy or actinic radiation incident at the proper angles to produce the required dot or slot locations. The exposures can be conducted either sequentially or simultaneously. Apparent modification of that general method would involve the use of ultraviolet laser beams and, in more sophisticated systems, incorporate computer-controlled, focussed high energy or actinic radiation or computer-controlled laser beams of ultraviolet radiation, wherein variations in intensity, time, and location predetermine the geometry and colors of the pattern.

Because the exposure through a shadow mask having apertures of standard size might yield dots or slots of inadequate sizes for efficient use of phosphor powder, it was observed that in the preferred practice the mask had somewhat enlarged apertures on standard centers. Finally, it was noted that a mask having actual holes therein was not necessary since a transparent glass with the mask prepared in an opaque layer by photoetching techniques would be equally applicable.

It is apparent that such technique could be utilized for preparing a glass plate suitable for use in the Screen-Plate Process for color photography. A ready modification thereof could be undertaken to provide more than three color subelements. For example, as is explained in U.S. Pat. No. 4,017,318, the intensity and duration of the initial exposure of the glass to high energy or actinic radiation which develops a latent image in the glass determines the final color which will be produced therein. Thus, the least quantum of exposure results in the development of a green color, followed by blue, violet, red, orange, and yellow as the time and/or intensity of the exposure is increased. Accordingly, a patterned array of micromosaic color dots (or other configuration) made up of these six colors can be prepared by subjecting a plate of polychromatic glass to six different exposures to high energy or actinic radiation, one for each of six different shadow mask positions, and subsequently developing six sets of color dots via heat treatments and exposures. The cited exposures can be conducted sequentially or simultaneously.

Most preferably, for photographic applications the patterned array will be so designed that all the space will be filled with colors or the presence of colorless portions will be strictly limited to controlled areas. If desired, one of the "colors" can be white or clear and colorless. Such will provide a black and white component.

One relatively simple method for insuring that all the space will be completely filled with color involves subjecting the entire polychromatic glass plate to the required exposure to produce green dots and thereafter further exposing the plate either simultaneously or sequentially to develop the other colors. In this manner the final glass will exhibit an overall green background. Obviously, the colors must be so patterned that this green background enhances rather than detracts from the overall effect desired.

Finally, rather than subjecting the polychromatic plate to two exposures of high energy or actinic radiation, the second exposure and heat treatment can be replaced with the heat treatment undertaken in a reducing environment as disclosed in U.S. Pat. No. 4,118,214, supra. Besides reducing the expense entailed in a second exposure to high energy or actinic radiation, the reducing atmosphere treatment has the beneficial factor of being capable of producing a very thin (~25–50 microns) layer of more intense color than is possible in other methods. Advantages inherent to thin, intense color layers include:

(a) higher photographic resolution (less parallax);
(b) the potential of employing very thin microsheet;
(c) the potential of utilizing very thin surface layers of polychromatic glass laminated or otherwise attached to a substrate or core of less expensive glass to form a composite unit; and
(d) the potential of applying different color patterns on opposite faces of thin sheets.

This last advantage offers the opportunity for color enhancement by duplicating color arrays on both sides, or of combining subtractive colors with additive colors. For example, a magenta dot on one side backed by a yellow dot on the other will appear red by transmission, and a magenta dot on one side backed by a cyan dot would yield a blue color by transmission.

The application of the panchromatic black and white positive emulsion can be undertaken utilizing coating methods conventional to the art.

DESCRIPTION OF THE PREFERRED EMBODIMENTS

The following compositions, expressed in parts by weight on the oxide basis as calculated from the batch, define glasses which are operable in the instant invention and come within the above-cited preferred glass compositions of U.S. Pat. No. 4,017,318. Because it is not known with which cation(s) the halides are combined, they are simply tabulated as halide, in accordance with conventional glass analysis practice. Moreover, since the content of silver is extremely small, it is merely reported as Ag. Finally, inasmuch as the total of the individual components closely approximates 100, for all practical purposes each figure listed may be considered to be essentially equivalent to weight percent.

The actual batch ingredients may comprise any material, either the oxide or other compound, which, when melted together with the other constituents, will be converted into the desired oxide in the proper proportions. The halides are commonly added as alkali metal halides.

| | 1 | 2 |
|---|---|---|
| $SiO_2$ | 72.0 | 64.7 |
| $Na_2O$ | 16.2 | 16.4 |
| ZnO | 5.0 | 5.9 |
| $Al_2O_3$ | 6.8 | 12.6 |
| F | 2.8 | 3.4 |
| Br | 0.4 | 1.0 |
| $CeO_2$ | 0.1 | 0.05 |
| Ag | 0.03 | 0.01 |
| $Sb_2O_3$ | 0.3 | 0.19 |
| SnO | 0.09 | 0.12 |

During the melting of the batch ingredients, up to as much as 50% by weight of the halide components and up to as much as 30% by weight of the silver may be volatilized away. However, the inclusion of additional amounts of those components to compensate for such losses is well within the technical ingenuity of the glass technologist.

The batch materials were compounded, ballmilled together to aid in obtaining a homogeneous melt, and deposited into a platinum crucible. A lid was placed on the crucible, the crucible moved to a furnace operating at about 1450° C., and the batch melted for about four hours with occasional stirring. Discs about three inches in diameter and about 4–5 mm in thickness were pressed from the melt and then annealed at about 460° C. After annealing, both sides of the disc were ground and polished to give a thickness of about 1.5 mm.

Whereas the above description referred to a laboratory scale melting procedure, it will be appreciated that the cited composition could be used in large scale, commercial melting operations. In such practice, glass sheet would advantageously be drawn rather than pressing discs.

FIGS. 1–9 depict a process that can be carried out in the laboratory for producing six-element color composites in the above-described disc. This procedure must be deemed illustrative only and not limitative of the invention. Hence, as was observed previously in the Summary of the Invention, other methods are available for imprinting an array of color spots into the glass.

Figure 1:
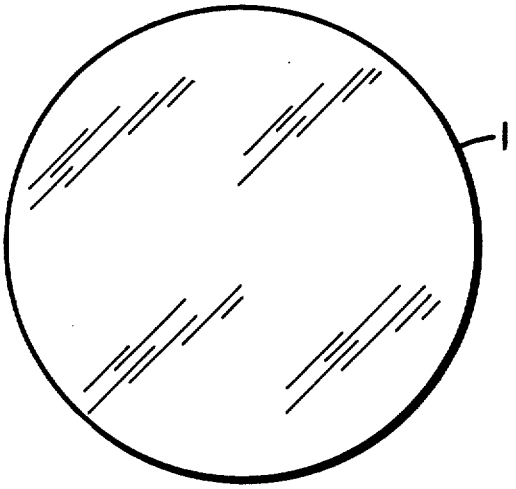
Figure 2:
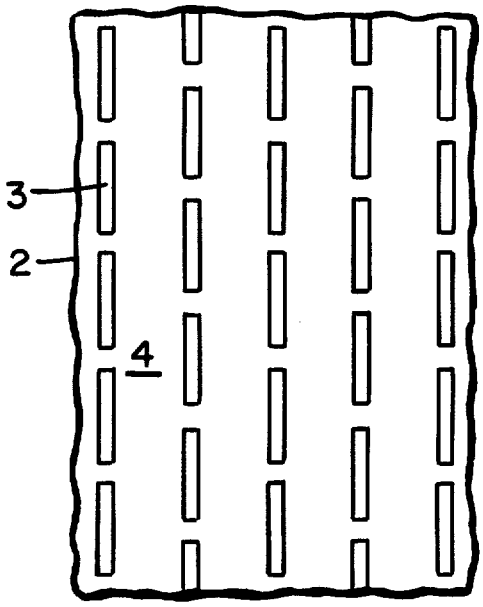
Figure 3:
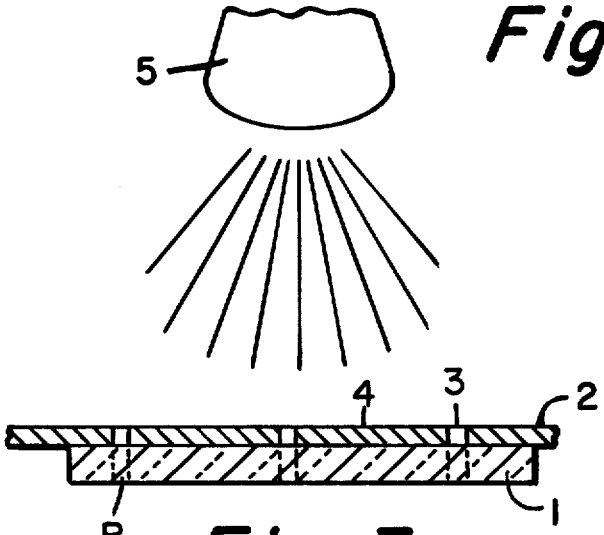
Figure 4:
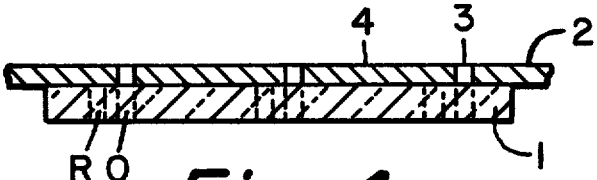
Figure 5:
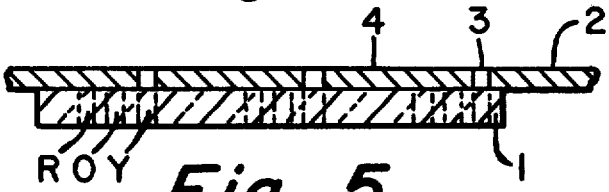
Figure 6:
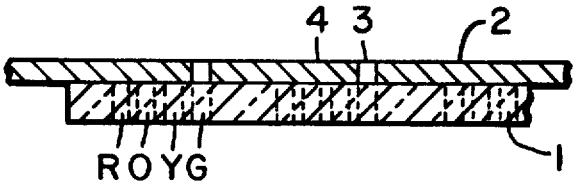
Figure 7:
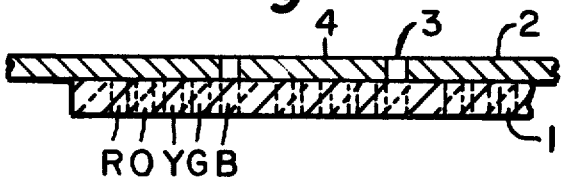
Figure 8:
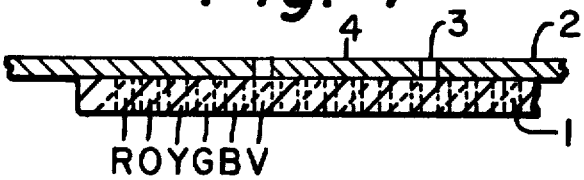
Figure 9:
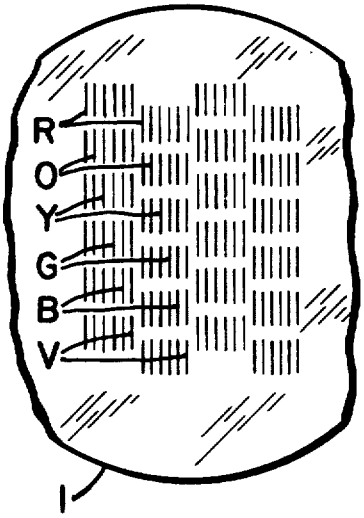

FIG. 1 represents disc 1 and FIG. 2 shows a metal grid or screen 2 with slot-shaped apertures 3 in staggered relationship to each other having a width slightly less than one-sixth the width of the metal web 4 between the slots. Speaking generally, the width will be about equivalent to the reciprocal of the number of subelement color filters desired. FIG. 3 portrays metal grid 2 in contact with the top surface of disc and the combination being irradiated with a source of actinic radiation 5, the beam therefrom passing through slots 3 to impinge upon disc 1. FIG. 4 depicts metal grid 2 horizontally displaced along the top surface of disc 1 such that, when the combination is again subjected to the source of actinic radiation 5, the beam therefrom passing through slots 3 will impinge upon disc 1 slightly spaced apart from the area originally exposed. FIG. 5 represents grid 2 further horizontally displaced along the top surface of disc 1, the amount of displacement being essentially the same as the undertaken in FIG. 4. Exposure of the combination to a source of actinic radiation 5 causes the beam to pass through slots 3 and strike disc 1 in an area spaced apart from the exposed area of FIG. 4 at a distance essentially the same as that existing between the exposed areas of FIGS. 3 and 4. FIG. 6 illustrates grid 2 further horizontally displaced along the top surface of disc 1, the amount of displacement being essentially the same as that described in FIG. 4. Exposure of the combination to a source of actinic radiation 5 results in the beam passing through slots 3 to strike disc 1 in an area spaced apart from the exposed areas of FIGS. 4 and 5 at a distance essentially the same as that existing between the exposed areas of FIGS. 3–5. FIG. 7 shows grid 2 still further horizontally displaced along the top surface of the disc 1, the amount of that displacement being essentially the same as that disclosed in FIG. 4. Exposure of the combination to a source of actinic radiation 5 causes the beam passing through slots 3 to strike disc 1 in an area spaced apart from the exposed areas of FIGS. 4–6 at a distance substantially the same as that existing between the exposed areas of FIGS. 3–6. FIG. 8 pictures grid 2 still further horizontally displaced along the top surface of disc 1, the amount of that displacement being essentially the same as that disclosed in FIG. 4. Exposure of the combination to a source of actinic radiation 5 results in the beam passing through slots 3 to strike disc 1 in an area spaced apart from the exposed areas of FIGS. 4–7 at a distance essentially the same as that existing between the exposed areas of FIGS. 3–7. The lengths of the exposures determine the color produced shown in FIGS. 3–8 as yellow (Y), orange (O), red (R), violet (V), blue (B), and green (G). FIG. 9 represents, in part, the pattern of six-element color composites that is produced when metal grid 2 is removed and disc 1 is further treated.

In carrying out the procedure as portrayed in FIGS. 1–9, a 2500 watt mercury vapor lamp system having substantial intensity at a wavelength of about 3000 A supplied a source of ultraviolet radiation. Other sources of ultraviolet radiation can be utilized, of course, and, as has been observed above, high energy electrons and X-radiations are also suitable to achieve the necessary photoreduction of the silver ions. As represented in FIGS. 3–8, the composite unit of metal grid 2 and disc 1 was positioned in the focal plane of the ultraviolet lamp system 5. An exposure of about 70 seconds was employed for the green slot, about 100 seconds for the blue slot, about 120 seconds for the violet slot, about 150 seconds for the red slot, about 200 seconds for the orange slot, and about 250 seconds for the yellow slot.

Subsequently, metal grid 2 was removed and disc 1 transferred to an electrically-heated furnace where it was heated at a rate of about 10° C./minute to 520° C. After about 1 hour the disc was allowed to cool to room temperature. The disc was thereafter introduced into an electrically-heated oven and, while at a temperature of 350° C. therein, exposed to ultraviolet lamp 5 for about 0.5 hour. Six-element color composites were obtained in disc 1 as illustrated in FIG. 9.

The initial heat treatment was conducted above the transformation range of the glass, but below the softening point thereof. (The transformation range has been defined as that temperature at which a liquid melt has become an amorphous solid, such temperature being deemed to lie in the vicinity of the annealing point of the glass.) The second exposure and heat treatment were carried out simultaneously at a temperature below the transformation range of the glass. Hence, the second exposure and heat treatment were undertaken following the practice outlined in U.S. Pat. No. 4,092,139, supra.

It will be recognized that the flux of the exposure to high energy or actinic radiation required to develop a latent image leading to the subsequent production of each color is dependent upon glass composition, as is the heat treatment. The determination of these parameters, however, is well within the technical skill of the glass technologist.

Moreover, it will also be appreciated that various modifications in exposure-heat treatment sequences are operable. For example, the initial exposure can be conducted at temperatures between about 200°–410° C. This practice allows the exposure time to be reduced. Thereafter, the glass will be heat treated at a temperature between the transformation range and the softening point thereof. Further, after the initial sequence of exposure and heat treatment, the glass can be cooled, reexposed to high energy or actinic radiation, and then heated to a temperature between the transformation range and the softening point of the glass to bring out the colors.

In another specific example of the inventive method, disc 1 was exposed through grid 2 in like manner to that described in FIGS. 3–8, utilizing the same exposure times as cited above for the six color areas. Grid 2 was thereafter removed and disc 1 was moved to an electrically-heated furnace, heated at a rate of about 10° C./minute to 520° C., held thereat for about 1 hour, and thereafter cooled to room temperature. Disc 1 was then transferred to an electrically-heated tube furnace through which hydrogen gas can be passed. After purging the tube with hydrogen gas, disc 1 was subjected to a treatment of about 16 hours at 400° C. utilizing a hydrogen gas flow rate sufficient to maintain an atmosphere of pure hydrogen, about 1 $ft^3$/hour. Six-element color composites were formed in disc 1 as depicted in FIG. 9.

I claim:

1. In the screen-plate color photographic process wherein the camera exposure is made through a screen consisting of a patterned mosaic array of red, green, and blue filters applied as coatings onto the surface of a glass plate, said screen being placed into contact with a panchromatic film of the type utilized in black-and-white photography, and after exposure the film is developed to provide a positive image, the improvement comprising utilizing as said glass plate a glass body suitable as said glass plate or a glass body suitable for attachment to said glass plate to form a composite unit, said glass body having a thickness of 0.01–1.5 mm and having within its surface an integral, patterned, uniform micromosaic array of polycolor elements consisting of 3–8 subelement color filters, said patterned array being so designed that all the space will be filled with colors or the presence of colorless portions will be strictly limited to controlled areas, the size of said polycolor elements not exceeding about 0.020", said glass plate being prepared by the following steps:

(a) forming said glass body suitable as said glass plate or said glass body suitable for attachment to said glass plate to form a composite unit from a composition consisting essentially, in weight percent on the oxide basis as calculated from the batch, of about 10–20% $Na_2O$, 0.0005–0.3% Ag, 1–4% F, an amount of at least one halide selected from the group of Cl, Br, and I at least sufficient to react stoichiometrically with the Ag, but not more than 3%, and the remainder $SiO_2$;

(b) exposing said glass body to high energy or actinic radiation for a period of time sufficient to produce a latent image therein capable of being developed into said integral, patterned, uniform micromosaic array of polycolor elements utilizing a method selected from the group consisting of:

(1) a single exposure through a patterned, continuous tone, black-and-white photographic negative, the pattern having 3–8 different optical densities;

(2) 3–8 exposures through appropriately patterned screens or stencils;

(3) a scanning exposure to a focused beam or a laser beam of ultraviolet radiation;

(c) heating at least said exposed portions of said glass body to a temperature between the transformation range of the glass and the softening point thereof for a sufficient length of time to cause nucleation and growth of microcrystals os alkali metal fluoride containing at least one silver halide selected from the group of silver chloride, silver bromide, and silver iodide in the areas of said latent image;

(d) subjecting at least said previously-exposed portions of said glass body to high energy or actinic radiation while at least said portions are at a temperature between about 200°–410° C. for a sufficient length of time to cause metallic silver to be deposited as discrete colloidal particles less than about 200 Å in the smallest dimension, and/or deposited upon the surface of said microcrystals, the silver-coated part of the microcrystal being less than about 200 Å in the smallest dimension, and/or deposited within said microcrystals, the silver-containing part of said microcrystal being less than 200 Å in the smallest dimension, said microcrystals having a concentration of at least 0.005% by volume and causing the desired integral coloration; and then (e) cooling said glass body to ambient temperature.

2. A process according to claim 1 wherein the silver content of said glass body will not exceed about 0.1%, the fluoride content of said glass body will not exceed about 3%, and the total of the remaining halides will not exceed about 2%.

3. A process according to claim 1 wherein said glass body also contains about 0.01–0.2% $CeO_2$.

4. A process according to claim 1 wherein said glass body also contains up to 18% ZnO and/or up to 10% $Al_2O_3$.

5. A process according to claim 1 wherein the concentration of said microcrystals in said integrally-colored portions does not exceed about 0.1% by volume and the size thereof does not exceed about 0.1 micron in diameter.

6. A process according to claim 1 wherein said glass body consists of polychromatic glass.

7. In the screen-plate color photographic process wherein the camera exposure is made through a screen consisting of a patterned mosaic array of red, green, and blue filters applied as coatings onto the surface of a glass plate, said screen being placed into contact with a panchromatic film of the type utilized in black-and-white photography, and after exposure the film is developed to provide a positive image, the improvement comprising utilizing as said glass plate a glass body suitable as said glass plate or a glass body suitable for attachment to said glass plate to form a composite unit, said glass body having a thickness of about 0.01–1.5 mm and having within its surface an integral, patterned, uniform micromosaic array of polycolor elements consisting of 3–8 subelement color filters, said patterned array being so designed that all the space will be filled with colors or the presence of colorless portions will be strictly limited to controlled areas, the size of said polycolor elements not exceeding about 0.020", said glass plate being prepared by the following steps:

(a) forming said glass body suitable as said glass plate or said glass body suitable for attachment to said glass plate to form a composite unit from a composition consisting essentially, in weight percent on the oxide basis as calculated from the batch, of about 10–20% $Na_2O$, 0.0005–0.3% Ag, 1–4% F, an amount of at least one halide selected from the group of Cl, Br, and I at least sufficient to react stoichiometrically with the Ag, but not more than 3%, and the remainder $SiO_2$;

(b) placing an appropriate mask into contact with said glass body at a position to expose a portion of the pattern area equivalent to the reciprocal of the number of color subelement filters desired;

(c) subjecting said portion of the pattern area to high energy or actinic radiation for a period of time sufficient to develop a latent image therein leading to the production of a first integral color therein;

(d) moving said mask or said glass body a distance across said glass body equal to the portion of the pattern area described in Step (b):

(e) subjecting that portion of the pattern area to high energy or actinic radiation for a period of time sufficient to develop a latent image therein leading to the production of a second integral color therein;

(f) repeating Steps (d) and (e) the required number of times to produce the desired number of subelement color filters;

(g) heating at least said exposed portions of said glass body to a temperature between the transformation range of the glass and the softening point thereof for a sufficient length of time to cause nucleation and growth of microcrystals of alkali metal fluoride containing at least one silver halide selected from the group of silver chloride, silver bromide, and silver iodide in the areas of said latent image;

(h) subjecting at least said previously-exposed portions of said glass body to high energy or actinic radiation while at least said portions are at a temperature between about 200°–410° C. for a sufficient length of time to cause metallic silver to be deposited as discrete colloidal particles less than about 200 Å in the smallest dimension, and/or deposited within said microcrystals, the silver-containing part of the microcrystal being less than 200 Å in the smallest dimension, and/or deposited on the surface of said microcrystals, the silver-coated part of the microcrystal being less than about 200 Å in the smallest dimension, said microcrystals having a concentration of at least 0.005% by volume and causing the desired integral coloration; and then (i) cooling said glass body to ambient temperature.

8. A process according to claim 7 wherein the silver content of said glass body will not exceed about 0.1%, the fluoride content of said glass body will not exceed about 3%, and the total of the remaining halides will not exceed about 2%.

9. A process according to claim 7 wherein said glass body also contains about 0.01–0.2% $CeO_2$.

10. A process according to claim 7 wherein said glass body also contains up to 18% ZnO and/or up to 10% $Al_2O_3$.

11. A process according to claim 7 wherein the concentration of said microcrystals in said integrally-colored portions does not exceed about 0.1% by volume and the size thereof does not exceed about 0.1 micron in diameter.

12. A process according to claim 7 wherein said glass body consists of a polychromatic glass.

13. A process according to claim 7 wherein said mask has somewhat enlarged holes on standard centers.

14. In the screen-plate color photographic process wherein the camera exposure is made through a screen consisting of a patterned mosaic array of red, green, and blue filters applied as coatings onto the surface of a glass plate, said screen being placed into contact with a panchromatic film of the type utilized in black-and-white photography, and after exposure the film is developed to provide a positive image, the improvement comprising utilizing as said glass plate a glass body suitable as said glass plate or a glass body suitable for attachment to said glass plate to form a composite unit, said glass body having a thickness of 0.01–1.5 mm and having within its surface an integral, patterned, uniform micromosaic array of polycolor elements consisting of 3–8 subelement color filters, said patterned array being so designed that all the space will be filled with colors or the presence of colorless portions will be strictly limited to controlled areas, the size of said polycolor elements not exceeding about 0.020", said glass plate being prepared by the following steps:

(a) forming said glass body suitable as said glass plate or said glass body suitable for attachment to said glass plate to form a composite unit from a composition consisting essentially, in weight percent on the oxide basis as calculated from the batch, of about 10–20% $Na_2O$, 0.0005–0.3% Ag, 1–4% F, an amount of at least one halide selected from the group of Cl, Br, and I at least sufficient to react stoichiometrically with the Ag, but not more than 3%, and the remainder $SiO_2$;

(b) placing an appropriate mask into contact with said glass body at a position to expose a portion of the pattern area equivalent to the reciprocal of the number of color subelement filters desired;

(c) subjecting said portion of the pattern area to high energy or actinic radiation for a period of time sufficient to develop a latent image therein leading to the production of a first integral color therein;

(d) moving said mask or said glass body a distance across said glass body equal to the portion of the pattern area described in Step (h);

(e) subjecting that portion of the pattern area to high energy or actinic radiation for a period of time sufficient to develop a latent image therein leading to the production of a second integral color therein;

(f) repeating Steps (d) and (e) the required number of times to produce the desired number of subelement color filters;

(g) heating at least said exposed portions of said glass body to a temperature between the transformation range of the glass and the softening point thereof for a sufficient length of time to cause nucleation and growth of microcrystals of alkali metal fluoride containing at least one silver halide selected from the group of silver chloride, silver bromide, and silver iodide in the areas of said latent image;

(h) subjecting at least said previously-exposed portions of said glass body to high energy or actinic radiation;

(i) heating said glass body to a temperature between the transformation range of the glass and the softening point thereof for a sufficient length of time to cause metallic silver to be deposited as discrete colloidal particles less than 200Å in the smallest dimension, and/or deposited within said microcrystals, the silver-containing part of the microcrystal being less than 200 Å in the smallest dimension, and/or deposited on the surface of said microcrystals, the silver-coated part of the microcrystal being less than 200 Å in the smallest dimension, said microcrystals having a concentration of at least 0.005% by volume and causing the desired integral coloration; and then (j) cooling said glass body to ambient temperature.

15. A process according to claim 14 wherein the silver content of said glass body will not exceed about 0.1%, the fluoride content of said glass body will not exceed about 3%, and the total of the remaining halides will not exceed about 2%.

16. A process according to claim 14 wherein said glass body also contains about 0.01–0.2% $CeO_2$.

17. A process according to claim 14 wherein said glass body also contains up to 18% ZnO and/or up to 10% $Al_2O_3$.

18. A process according to claim 14 wherein the concentration of said microcrystals in said integrally-colored portions does not exceed about 0.1% by volume and the size thereof does not exceed about 0.1 micron in diameter.

19. A process according to claim 14 wherein said glass body consists of a polychromatic glass.

20. A process according to claim 14 wherein said mask has somewhat enlarged holes on standard centers.

21. In the screen-plate color photographic process wherein the camera exposure is made through a screen consisting of a patterned mosaic array of red, green, and blue filters applied as coatings onto the surface of a glass plate, said screen being placed into contact with a panchromatic film of the type utilized in black-and-white photography, and after exposure the film is developed to provide a positive image, the improvement comprising utilizing as said glass plate a glass body suitable as said glass plate or a glass body suitable for attachment to said glass plate to form a composite unit, said glass body having a thickness of 0.01–1.5 mm and having within its surface an integral, patterned, uniform micromosaic array of polycolor elements consisting of 3–8 subelement color filters, said patterned array being so designed that all the space will be filled with colors or the presence of colorless portions will be strictly limited to controlled areas, the size of said polycolor elements not exceeding about 0.020", said glass plate being prepared by the following steps:

(a) forming said glass body suitable as said glass plate or said glass body suitable for attachment to said glass plate to form a composite unit from a composition consisting essentially, in weight percent on the oxide basis as calculated from the batch, of about 10–20% $Na_2O$, 0.0005–0.3% Ag, 1–4% F, an amount of at least one halide selected from the group of Cl, Br, and I at least sufficient to react stoichiometrically with the Ag, but not more than 3%, and the remainder $SiO_2$;

(b) placing an appropriate mask into contact with said glass body at a position to expose a portion of the pattern area equivalent to the reciprocal of the number of color subelement filters desired;

(c) subjecting said portion of the pattern area to high energy or actinic radiation for a period of time sufficient to develop a latent image therein leading to the production of a first integral color therein;

(d) moving said mask or said glass body a distance across said glass body equal to the portion of the pattern area described in Step (b);

(e) subjecting that portion of the pattern area to high energy or actinic radiation for a period of time sufficient to develop a latent image therein leading to the production of a second integral color therein;

(f) repeating Steps (d) and (e) the required number of times to produce the desired number of subelement color filters;

(g) heating at least said exposed portions of said glass body to a temperature between the transformation range of the glass and the softening point thereof for a sufficient length of time to cause nucleation and growth of microcrystals of alkali metal fluoride containing at least one silver halide selected from the group of silver chloride, silver bromide, and silver iodide in the areas of said latent image;

(h) subjecting at least said exposed portions of said glass body to a gaseous reducing atmosphere at a temperature of at least 350° C., but less than about the strain point of the glass, for a sufficient length of time to cause metallic silver to be deposited as discrete colloidal particles less than 200 Å in the smallest dimension, and/or deposited within said microcrystals, the silver-containing part of the microcrystal being less than 200 Å in the smallest dimension, and/or deposited on the surface of said microcrystals, the silver-coated part of the microcrystal being less than 200 Å in the smallest dimension, said microcrystals having a concentration of at least 0.005% by volume and causing the desired integral coloration; and then (i) cooling said glass body to ambient temperature.

22. A process according to claim 21 wherein the silver content of said glass body will not exceed about 0.1%, the fluoride content of said glass body will not exceed about 3%, and the total of the remaining halides will not exceed about 2%.

23. A process according to claim 21 wherein said glass body also contains about 0.01–0.2% $CeO_2$.

24. A process according to claim 21 wherein said glass body also contains up to 18% ZnO and/or up to 10% $Al_2O_3$.

25. A process according to claim 21 wherein the concentration of said microcrystals in said integrally-colored portions does not exceed about 0.1% by volume and the size thereof does not exceed about 0.1 micron in diameter.

26. A process according to claim 21 wherein said glass body consists of a polychromatic glass.

27. A process according to claim 21 wherein said mask has somewhat enlarged holes on standard centers.

28. A process according to claim 21 wherein said gaseous reducing atmosphere is selected from the group consisting of a hydrogen-containing gas, cracked ammonia, and mixtures of CO and $CO_2$.

29. A process according to claim 28 wherein said hydrogen-containing gas is selected from the group consisting of hydrogen and forming gas.

30. A process according to claim 28 wherein said gaseous reducing atmosphere is at a pressure greater than ambient pressure.

31. A process according to claim 28 wherein said gaseous reducing atmosphere is wet.

32. In the screen-plate color photographic process wherein the camera exposure is made through a screen consisting of a patterned mosaic array of red, green, and blue filters applied as coatings onto the surface of a glass plate, said screen being placed into contact with a panchromatic film of the type utilized in black-and-white photography, and after exposure the film is developed to provide a positive image, the improvement comprising utilizing as said glass plate a glass body suitable as said glass plate or a glass body suitable for attachment to said glass plate to form a composite unit, said glass body having a thickness of about 0.01–1.5 mm and having within its surface an integral, patterned, uniform micromosaic array of polycolor elements consisting of 3–8 subelement color filters, said patterned array being so designed that all the space will be filled with colors or the presence of colorless portions will be strictly limited to controlled areas, the size of said polycolor elements not exceeding about 0.020", said glass plate being prepared by the following steps:

(a) forming said glass body suitable as said glass plate or said glass body suitable for attachment to said glass plate to form a composite unit from a composition consisting essentially, in weight percent on the oxide basis as calculated from the batch of about 10–20% $Na_2O$, 0.0005–0.3% Ag, 1–4% F, an amount of at least one halide selected from the group of Cl, Br, and I at least sufficient to react stoichiometrically with the Ag, but not more than 3%, and the remainder $SiO_2$;

(b) placing an appropriate mask at an appropriate uniform distance from said glass body;

(c) directing collimated high energy or actinic radiation through said mask at the proper angle to expose a portion of the pattern area equivalent to the reciprocal of the number of sublement filters desired for a period of time sufficient to develop a latent image therein leading to the production of a first integral color therein;

(d) repeating Step (c) at varying proper angles of exposure the required number of times to produce the desired number of subelement color filters;

(e) heating at least said exposed portions of said glass body to a temperature between the transformation range of the glass and the softening point thereof for a sufficient length of time to cause nucleation and growth of microcrystals of alkali metal fluoride containing at least one silver halide selected from the group of silver chloride, silver bromide, and silver iodide in the areas of said latent image;

(f) subjecting at least said exposed portions of said glass body to a gaseous reducing atmosphere at a temperature of at least 350° C., but less than about the strain point of the glass, for a sufficient length of time to cause metallic silver to be deposited as discrete colloidal particles less than 200 Å in the smallest dimension, and/or deposited within said microcrystals, the silver-containing part of the microcrystal being less than 200 Å in the smallest dimension, and/or deposited on the surface of said microcrystals, the silver-coated part of the microcrystal being less than 200 Å in the smallest dimension, said microcrystals having a concentration of at least 0.005% by volume and causing the desired integral coloration; and then (g) cooling said glass body to ambient temperature.

33. A process according to claim 32 wherein the silver content of said glass body will not exceed about 0.1%, the fluoride content of said glass body will not exceed about 3%, and the total of the remaining halides will not exceed about 2%.

34. A process according to claim 32 wherein said glass body also contains about 0.01–0.2% $CeO_2$.

35. A process according to claim 32 wherein said glass body also contains up to 18% ZnO and/or up to 10% $Al_2O_3$.

36. A process according to claim 32 wherein the concentration of said microcrystals in said integrally-colored portions does not exceed about 0.1% by volume and the size thereof does not exceed about 0.1 micron in diameter.

37. A process according to claim 32 wherein said glass body consists of a polychromatic glass.

38. A process according to claim 32 wherein said mask has somewhat enlarged holes on standard centers.

39. A process according to claim 32 wherein said exposures to collimated high energy or actinic radiation are conducted simultaneously.

40. A process according to claim 32 wherein said gaseous reducing atmosphere is selected from the group consisting of a hydrogen-containing gas, cracked ammonia, and mixtures of CO and $CO_2$.

41. A process according to claim 40 wherein said hydrogen-containing gas is selected from the group consisting of hydrogen and forming gas.

42. A process according to claim 40 wherein said gaseous reducing atmosphere is at a pressure greater than ambient pressure.

43. A process according to claim 40 wherein said gaseous reducing atmosphere is wet.

* * * * *